United States Patent [19]

Langer

[11] 4,127,368

[45] Nov. 28, 1978

[54] ROTOR FOR ECCENTRIC HELICAL GEAR PUMP

[76] Inventor: Paul G. Langer, Am Schiebhaus 28, 858 Bayreuth, Germany

[21] Appl. No.: 490,771

[22] Filed: Jul. 22, 1974

Related U.S. Application Data

[63] Continuation of Ser. No. 226,423, Feb. 15, 1972, abandoned.

[30] Foreign Application Priority Data

Feb. 19, 1971 [DE] Fed. Rep. of Germany ..... 2108083

[51] Int. Cl.[2] ..... F01C 1/10; B21D 39/02; B23K 31/02; B23P 15/10

[52] U.S. Cl. ..... 418/48; 418/220; 29/156.4 R; 29/463; 228/173 C; 228/182

[58] Field of Search ..... 418/191, 201, 205, 48, 418/220; 29/471.1, 156.4 R, 463; 113/116 D, 116 W; 228/173 C, 182, 231

[56] References Cited

U.S. PATENT DOCUMENTS

| | | | |
|---|---|---|---|
| 1,952,217 | 3/1934 | Patton | 29/471.1 X |
| 2,188,752 | 1/1940 | Houghton | 418/191 |
| 2,464,011 | 3/1949 | Wade | 418/48 |
| 2,532,145 | 11/1950 | Byram | 418/48 |
| 2,714,314 | 8/1955 | Ulander | 418/201 X |
| 3,186,063 | 6/1965 | Dopp | 29/471.1 X |
| 3,512,904 | 5/1968 | Allen | 418/48 |

*Primary Examiner*—John J. Vrablik
*Attorney, Agent, or Firm*—Browdy and Neimark

[57] ABSTRACT

A rotor for an eccentric gear pump is formed of two deep-drawn sheet metal halves welded together.

2 Claims, 2 Drawing Figures

ROTOR FOR ECCENTRIC HELICAL GEAR PUMP

Figure 1:
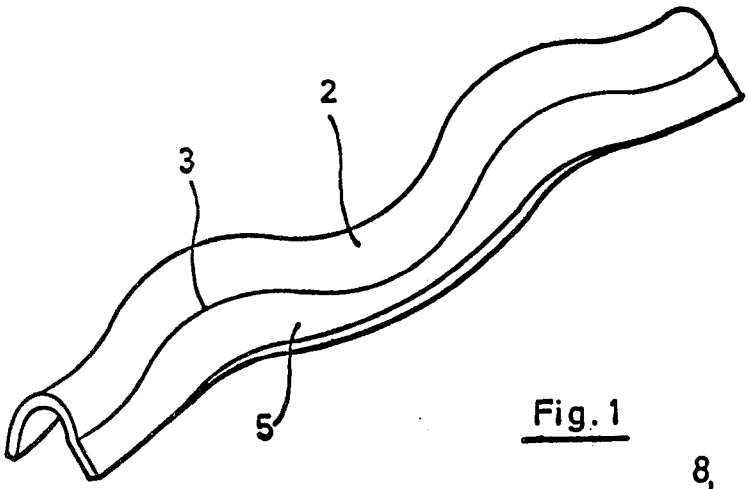

This is a continuation of application Ser. No. 226,423, filed Feb. 15, 1972, now abandoned.

The present invention relates to improved eccentric gear pumps, and, more particularly, to a hollow rotor for an eccentric helical gear pump.

Eccentric gear pumps are known in numerous embodiments, for example, in U.S. Pat. No. 2,512,764 and British Pat. No. 916,155. Such eccentric helical gear pumps normally consist of a housing, a stator of elastic material and a rotor. The internal bore of the stator and the rotor each have a helical pattern. The rotor is driven at one end through a connecting rod by the shaft of a driving motor, the connecting rod being connected through a universal joint, e.g. a so-called cardan joint, to the motor shaft at one end and the rotor at the other.

Such known rotors are normally cast solid or hollow or turned from round stock. Since it is never quite possible in hollowcasting to be sure that the core does not shift in the mold, relatively heavy wall thicknesses must be provided in advance, so that sufficient wall thicknesses will be obtained despite shifting of the core. On the other hand, due to the different wall thicknesses, there is the danger that stress cracks will develop during tempering.

In addition, there is always the danger of cavities in all cast bodies. Moreover, cast blanks must also be cast with a relatively large excess on the outside, so that relatively extensive working to turn off the excess material is required. In addition, the tempering of almost all cast metals is relatively problematical.

Moreover, it is difficult both economically and technically to make the rotors conform to the various requirements imposed by practice, for example, high heat strength, impact strength, abrasive resistance, corrosion resistance, etc. From the economic standpoint, this conformity poses problems because special metals are often used and high cost is commonly involved even in casting only very small pieces using such a special metal. There are technical procedural problems as well, because it is precisely such special alloys that are often capable of being cast only with difficulty.

A very critical problem consists in the fact that due to their eccentric travel, such rotors always have a considerable imbalance that becomes more serious as the wall thickness (due to casting), and hence the weight, increases. For this reason, the rpm of such rotors (and therefore the delivery rate of pumps using them) is limited.

It is therefore, an object of the invention to provide a hollow metal rotor for eccentric helical gear pumps which does not suffer from the above shortcomings.

It is another object of the present invention to provide for improved and more economical eccentric gear pumps. In general, it is an object of the present invention to overcome the deficiencies of the prior art.

These objects are attained by making the rotor with relatively thin walls of selected material, preferably metal, having approximately the same wall thickness over its entire circumference and its entire length.

According to an especially advantageous feature of the invention, the rotor consists of two half shells welded together, these shells preferably being of relatively thin sheet. In addition, it is also advantageous if the welded seams follow the course of the midline of the rotor.

A method for making such a rotor according to the present invention consists mainly in the fact that in each case two sheets are formed into two matching rotor halves by deep drawing, forging, or the like, these halves being joined together by welding.

The rotor according to the invention and the method for its manufacture according to the invention have a number of quite definite advantages: the fact that the rotor consists of two halves that are formed, for example, by forging and subsequently assembled by welding ensures that the rotor will have wall thicknesses that are everywhere substantially exactly the same. This makes it possible to eliminate the need for excess wall thickness in the rotor that would otherwise be required in casting. In addition, rolled sheet can be used, which usually provides greater strength than corresponding cast bodies.

In this manner, the wall thickness of the rotor can be further reduced. Aside from the saving of material, the rotor can thus be made much lighter, which means that eccentric helical gear pumps equipped with such rotors can achieve much higher delivery rates, since the rpm of these pumps can be increased. Due to the complete uniformity of the wall thicknesses, the problem of imbalance is also minimized. In addition, the rolled sheet that is used can normally be more easily tempered then can a casting.

Figure 2:
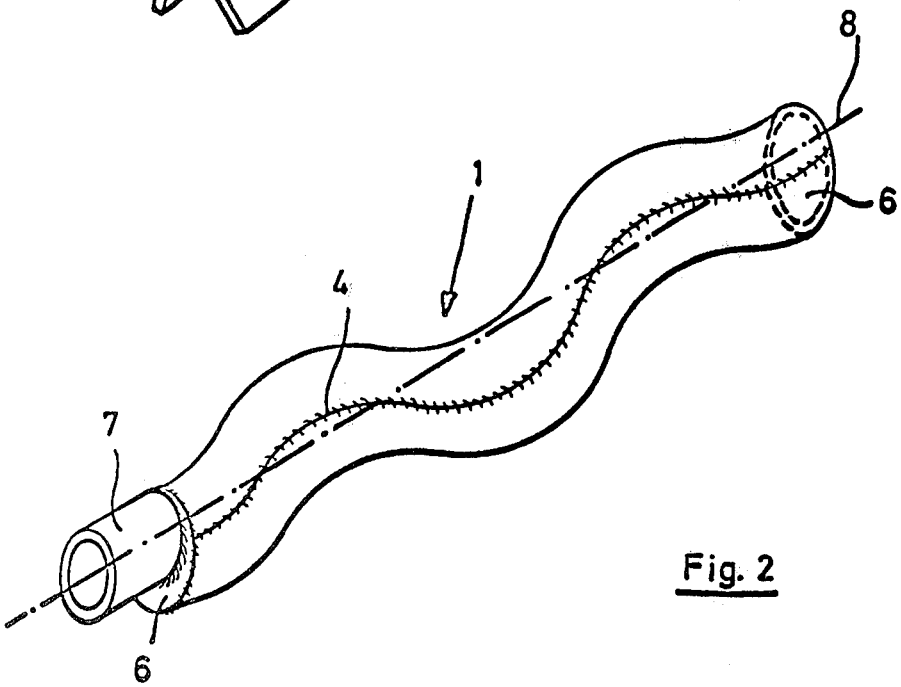

Further advantages and features of the invention will be evident from the description of a sample embodiment of the invention described below in conjunction with the drawing, wherein:

FIG. 1 is a perspective view of a rotor half shell after deep drawing or forging; and FIG. 2 is a perspective view of a complete, welded rotor.

A rotor 1 is shown which consists essentially of two half shells 2, manufactured by forging, deep-drawing, etc., the method of manufacture depending essentially on the nature and wall thickness of the material. In this case, the starting material consists of rectangular or appropriately form-cut sheets, the wall thickness of which is slightly greater than the desired wall thickness of the half shells 2.

The molds and/or dies, consisting of male and female members, are formed so that the half shells have an exactly semi-circular cross section everywhere. The lengthwise boundary lines 3, which coincide with the future welded seams 4, therefore follow exactly the midline of such a rotor.

FIG. 1 shows a rotor half shell 2, which still contains excess flange material remaining after forming. This excess flange is cut off, for example by a copying gas cutter. Then two matching half shells 2 are joined by a copying welder, for example, under a protective gas atmosphere, if needed. The two matching half shells are identical in shape and displaced relative to one another in the lengthwise direction by only a half turn.

After the welding together of the two half shells, the resultant rotor 1 is closed by welding a circular plate 6 to each end. At one end, the left end in FIG. 2, a tube stub 7 is welded on, for attachment of the connecting rod of the pump drive, the stub 7 being aligned with the axis 8 of the rotor; the techniques used in the fabrication of the rotor can be performed in known fashion.

When the rotor 1 has reached this stage of construction, it is turned or ground as much as necessary to correct for weld-seam or half-shell defects. Then the rotor is tempered and is ready to install in an eccentric helical gear pump, such as the type known in the prior art.

It will be obvious to those skilled in the art that various changes may be made without departing from the scope of the invention and the invention is not to be considered limited to what is shown in the drawings and described in the specification.

What is claimed is:

1. A tempered and turned or ground hollow eccentric helical rotor for an eccentric helical gear pump comprising two deep formed matching eccentric helical rotor half-shells having a relatively thin wall thickness and having a high impact strength and abrasive resistance, said half-shells being secured together by a weld at two opposite weld lines extending along the course of the midline of said rotor and having a circular plate secured to each end by a weld and a tube stub secured by a weld to one of said circular plates, said stub being aligned with the axis of said rotor.

2. A method of manufacturing a rotor for an eccentric helical gear pump, comprising:

deep forming two matching eccentric helical rotor half shells made from relatively thin sheet metal;

fastening said half shells together by welding;

welding a circular plate to each end of the formed rotor;

welding a tube stub to one of said circular plates, said stub being aligned with the axis of the rotor;

turning or grinding to correct for weld seam or half shell defects; and tempering the turned or ground rotor.

* * * * *